US010202875B2

(12) United States Patent
Son et al.

(10) Patent No.: US 10,202,875 B2
(45) Date of Patent: Feb. 12, 2019

(54) POWERTRAIN

(71) Applicant: Hyundai Motor Company, Seoul (KR)

(72) Inventors: You Sang Son, Gyeonggi-do (KR); Kyoung Pyo Ha, Gyeonggi-do (KR); Back Sik Kim, Gyeonggi-do (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 180 days.

(21) Appl. No.: 15/282,374

(22) Filed: Sep. 30, 2016

(65) Prior Publication Data

US 2017/0167309 A1 Jun. 15, 2017

(30) Foreign Application Priority Data

Dec. 14, 2015 (KR) ..... 10-2015-0178654
Aug. 11, 2016 (KR) ..... 10-2016-0102338

(51) Int. Cl.

| | |
|---|---|
| ***F01L 1/34*** | (2006.01) |
| ***F01L 1/047*** | (2006.01) |
| ***F01L 1/053*** | (2006.01) |
| ***F01L 1/356*** | (2006.01) |
| ***F01L 13/00*** | (2006.01) |

(52) U.S. Cl.

CPC ..... *F01L 1/047* (2013.01); *F01L 1/053* (2013.01); *F01L 1/34* (2013.01); *F01L 1/356* (2013.01); *F01L 13/0015* (2013.01); *F01L 2001/0473* (2013.01); *F01L 2001/0537* (2013.01); *F01L 2013/103* (2013.01)

(58) Field of Classification Search

CPC . F01L 1/047; F01L 1/356; F01L 1/053; F01L 1/34; F01L 13/0015; F01L 2013/103; F01L 2001/0537; F01L 2001/0473

USPC ..... 123/90.17

See application file for complete search history.

(56) References Cited

U.S. PATENT DOCUMENTS

2008/0257310 A1* 10/2008 Theobald ..... B60K 6/24 123/41 E
2017/0167321 A1* 6/2017 Son ..... F01L 1/047
2017/0167322 A1* 6/2017 Son ..... F01L 1/047

(Continued)

FOREIGN PATENT DOCUMENTS

| | | | |
|---|---|---|---|
| EP | 0586973 | A1 | 3/1994 |
| KR | 10-2013-0063819 | A | 6/2013 |
| WO | 2012/063309 | A1 | 5/2012 |

*Primary Examiner* — J. Todd Newton

(74) *Attorney, Agent, or Firm* — Brinks Gilson & Lione

(57) ABSTRACT

The present disclosure provides a powertrain including an engine housing to which a cylinder head and cam carrier are mounted, a camshaft mounted to the cam carrier, first and second cam portions on which cams are formed, in which the camshaft is inserted, of which relative phase angle with respect to the camshaft is variable and disposed corresponding to a first cylinder and second cylinder respectively, first and second inner brackets transmitting rotation of the camshaft to the first and second cam portions respectively, a slider housing in which the first and second inner brackets are rotatably inserted and of which a position with respect to the cam shaft is variable, a lifter control portion controlling the position of the slider housing, a motor assembly engaged with the engine housing and in which a flywheel connected with a crankshaft is rotatably disposed, and a transmission connected with the motor assembly.

13 Claims, 12 Drawing Sheets

(56) References Cited

U.S. PATENT DOCUMENTS

| | | | | |
|---|---|---|---|---|
| 2017/0167323 | A1* | 6/2017 | Son | F01L 1/047 |
| 2017/0167327 | A1* | 6/2017 | Son | F01M 1/16 |
| 2017/0284314 | A1* | 10/2017 | Son | F01L 1/053 |

* cited by examiner

POWERTRAIN

CROSS-REFERENCE TO RELATED APPLICATION

This application claims priority to and the benefit of Korean Patent Application No. 10-2015-0178654, filed on Dec. 14, 2015, and Korean Patent Application No. 10-2016-0102338 filed on Aug. 11, 2016 the entire contents of which are incorporated herein by reference.

FIELD

The present disclosure relates to a powertrain. More particularly, the present disclosure relates to a powertrain provided with a two cylinder engine and a motor which may improve output and fuel efficiency.

BACKGROUND

The statements in this section merely provide background information related to the present disclosure and may not constitute prior art.

Recently, research has been undertaken to enhance fuel efficiency of a vehicle, such as by designing a two cylinder engine or a three cylinder engine.

However, enhancing output and fuel efficiency of the two cylinder engine or the three cylinder engine may be limited according to various vehicle driving conditions.

Also, the two cylinder engine or the three cylinder engine outputs relatively serious vibration and applying an element, such as a balance shaft, for suppressing vibration to the two cylinder engine or the three cylinder engine may be limitative.

The above information disclosed in this Background section is only for enhancement of understanding of the background of the disclosure and therefore it may contain information that does not form the prior art that is already known to a person of ordinary skill in the art.

Further areas of applicability will become apparent from the description provided herein. It should be understood that the description and specific examples are intended for purposes of illustration only and are not intended to limit the scope of the present disclosure.

SUMMARY

The present disclosure provides a powertrain provided with a two cylinder engine and a motor which may improve output and fuel efficiency.

According to one form of the present disclosure, vibration may be suppressed using a motor assembly.

A powertrain according to one form of the present disclosure may include an engine housing connected to a cylinder head, and a cam carrier mounted to the cylinder head, a camshaft mounted to the cam carrier, a first cam portion on which a first cam is formed, in which the camshaft is inserted, of which a relative phase angle with respect to the camshaft is variable and disposed to correspond to a first cylinder, a second cam portion on which a second cam is formed, in which the camshaft is inserted, of which a relative phase angle with respect to the camshaft is variable and disposed to correspond to a second cylinder, first and second inner brackets transmitting rotation of the camshaft to the first and second cam portions, respectively, a slider housing in which the first and the second inner brackets are rotatably inserted and of which a relative position with respect to the cam shaft is variable, a lifter control portion controlling the relative position of the slider housing, a motor assembly engaged with the engine housing and in which a flywheel connected with a crankshaft is rotatably disposed, and a transmission connected with the motor assembly.

The lifter control portion may include a control shaft parallel to the camshaft and on which a control rod is eccentrically formed and a first guiding portion may be formed to an upper portion of the slider housing and a second guiding portion may be formed vertical to the first guiding portion, wherein the powertrain may further include a guide head on which a head guiding portion slidably connected with the first guiding portion is formed and on which a head hole where the control rod is rotatably inserted into is formed.

The powertrain may further include a housing guide on which a guide rail engaged with the second guiding portion is formed and mounted to the cam carrier for guiding movement of the slider housing.

A cam key may be formed in the first and second cam portions respectively, a first sliding hole may be formed in the first and second inner brackets respectively, and a cam key pin on which a cam key slot is formed and in which the cam key is slidably inserted, may be rotatably inserted into the first sliding hole in the first and second inner brackets.

A second sliding hole may be formed in the first and second inner brackets respectively, a camshaft pin may be connected to the camshaft, and a slider pin on which a camshaft pin slot is formed and in which the camshaft pin is slidably inserted, may be rotatably inserted into the second sliding hole in the first and second inner brackets.

The powertrain may further include a slider housing bearing disposed between the first and the second inner brackets and the slider housing respectively.

The powertrain may further include a partition disposed between the first and the second inner brackets.

The first cam formed to the first cam portion may be a pair of first cams and the second cam formed to the second cam portion may be a pair of second cams, a cam cap connecting portion may be formed between each of the pair of first cams and the pair of second cams of each cam portion, and a cam cap for rotatably supporting the control shaft and the cam cap connecting portion may be mounted to the cam carrier.

The powertrain may further include a control shaft supporting portion supporting the control shaft.

The powertrain may further include a spacer disposed between the control shaft and the control shaft supporting portion.

A cam key may be formed on the first and second cam portions respectively, a first and a second sliding hole may be formed in the first and the second inner brackets respectively, a cam key pin on which a cam key slot is formed and in which the cam key is slidably inserted, may be rotatably inserted into the first sliding hole of the first and second inner brackets, and a slider pin may include a pin body and a pin head integrally formed with the pin body, and wherein the pin body may be slidably inserted into the camshaft and the pin head may be rotatably inserted into the second sliding hole of the first and the second inner brackets.

A camshaft oil hole may be formed in the camshaft along a length direction thereof, a body oil hole in fluid communication with the camshaft oil hole may be formed in the pin body, and an oil groove in fluid communication with the body oil hole may be formed in the pin head.

The motor assembly may include a motor housing connected to the engine housing, a stator plate connected to the motor housing and a core plate connected to the stator plate and on which a coil is wound, wherein magnets corresponding to the coil may be connected to the flywheel.

As described above, a powertrain according to one form of the present disclosure may vary an opening duration of a valve according to operation conditions of an engine, with a simple construction.

A powertrain of the present disclosure may reduce vibration and reduce total size of the powertrain by using a motor assembly.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

and

Figure 12:
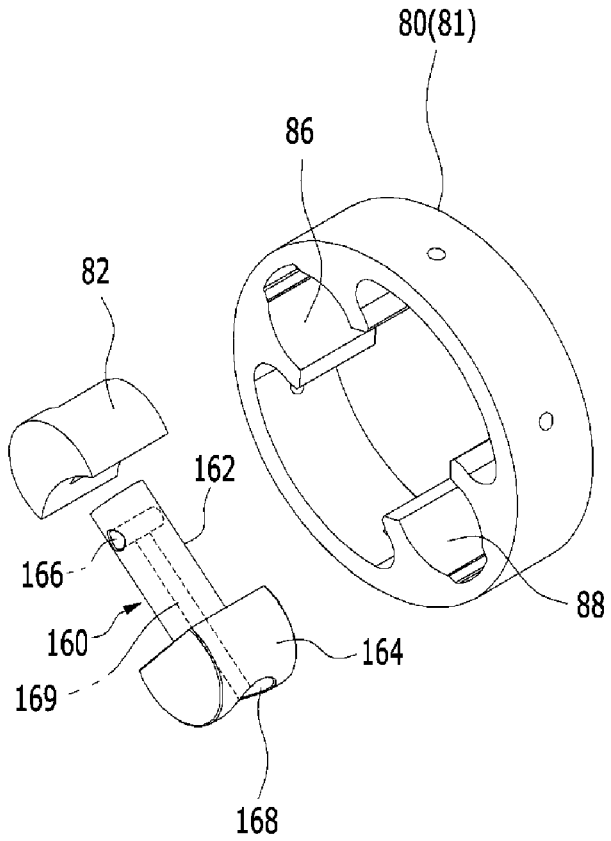

FIG. 12 is a drawing showing a slider pin applied to a powertrain of the present disclosure.

The drawings described herein are for illustration purposes only and are not intended to limit the scope of the present disclosure in any way.

| <Description of symbols> | |
|---|---|
| 1: engine | 10: cylinder head |
| 11: cam carrier | 12: engine housing |
| 30: camshaft | 32: camshaft hole |
| 40: cam cap | 44: control shaft supporting portion |
| 46: support bushing | 48: spacer |
| 50: guide head | 52: head guiding portion |
| 54: head hole | 60: camshaft pin |
| 62: housing guide | 64: guide rail |
| 70a, 70b: first, second cam portion | 71, 72: cam |
| 74: cam key | 76: cam connecting portion |
| 80: first inner bracket | 81: second inner bracket |
| 82: cam key pin | 83: cam key slot |
| 84: slider pin | 85: camshaft pin slot |

-continued

| <Description of symbols> | |
|---|---|
| 86: first sliding hole | 88: second sliding hole |
| 90: slider housing | 91: partition |
| 92: slider housing bearing | 93: first guiding portion |
| 95: second guiding portion | 100: lifter control portion |
| 106: control motor | 108: control shaft |
| 110: control rod | 120; motor assembly |
| 122: motor housing | 123: bolt |
| 124: stator plate | 126: coil groove |
| 130: core plate | 135: coil |
| 140: flywheel | 141: magnet |
| 150: crankshaft | 155: transmission |
| 160: slider pin | 162: pin body |
| 164: pin head | 166: body oil hole |
| 168: oil groove | 169: communicate hole |
| 200: valve | 211, 212: 1-2 cylinder |

DETAILED DESCRIPTION

The following description is merely exemplary in nature and is not intended to limit the present disclosure, application, or uses. It should be understood that throughout the drawings, corresponding reference numerals indicate like or corresponding parts and features.

In the following detailed description, only certain forms of the present disclosure have been shown and described, simply by way of illustration.

As those skilled in the art would realize, the described forms may be modified in various different ways, all without departing from the spirit or scope of the present disclosure A part irrelevant to the description will be omitted to clearly describe the present disclosure, and the same or similar elements will be designated by the same reference numerals throughout the specification.

In the drawings, the thickness of layers, films, panels, regions, etc., are exaggerated for clarity.

Throughout the specification and the claims, unless explicitly described to the contrary, the word "comprise" and variations such as "comprises" or "comprising", will be understood to imply the inclusion of stated elements but not the exclusion of any other elements.

Form of the present disclosure will hereinafter be described in detail with reference to the accompanying drawings.

Figure 1:
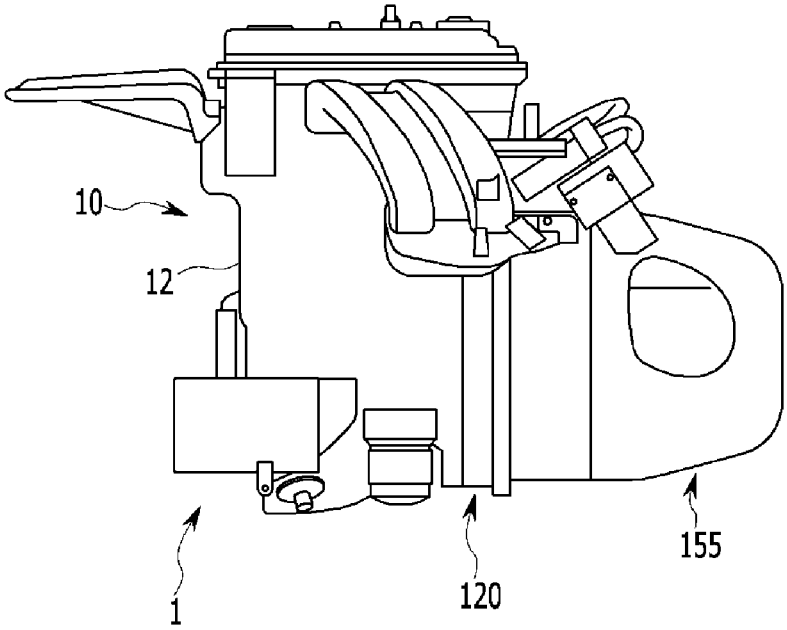
FIG. 1 is a front view of a powertrain according to one form of the present disclosure.
Figure 2:
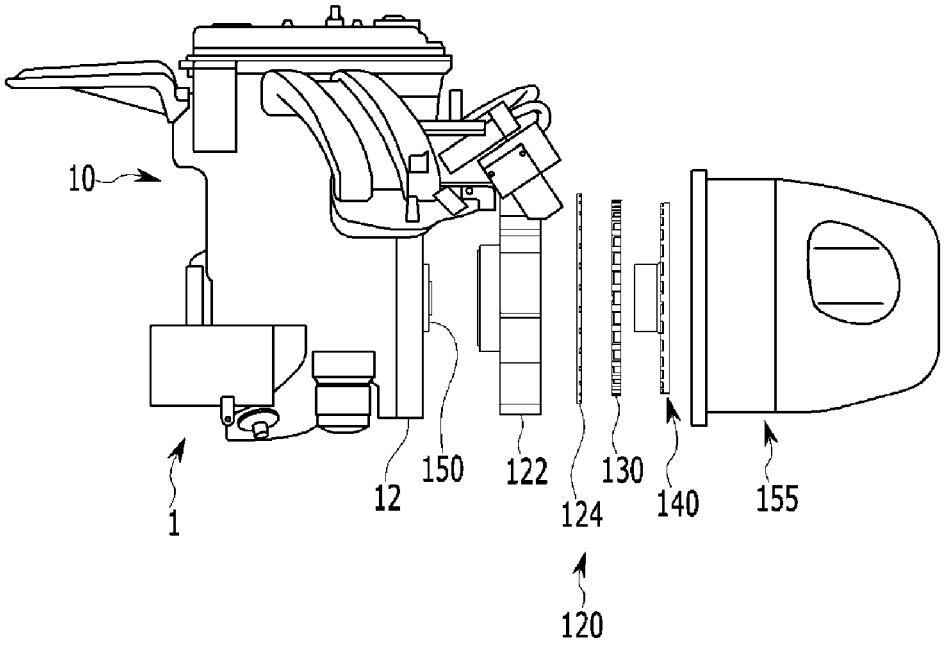
FIG. 2 is an exploded view of a powertrain of the present disclosure.

FIG. 1 is a front view of a powertrain according to one form of the present disclosure, and FIG. 2 is an exploded view of a powertrain of the present disclosure.

Figure 3:
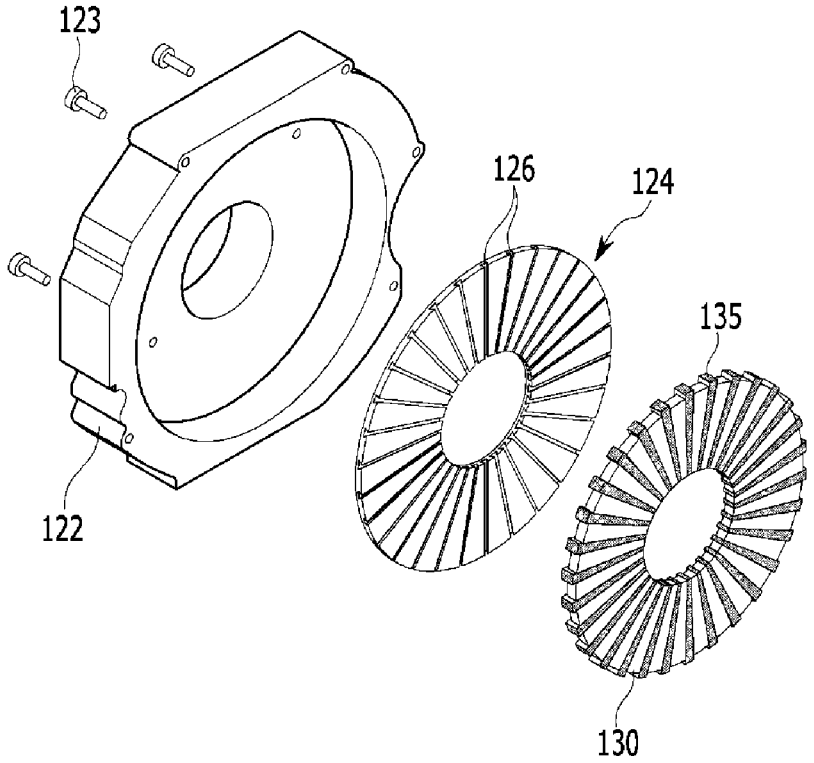
FIG. 3 and FIG. 4 are partial exploded perspective views of a motor assembly applied to a powertrain of the present disclosure.
Figure 4:
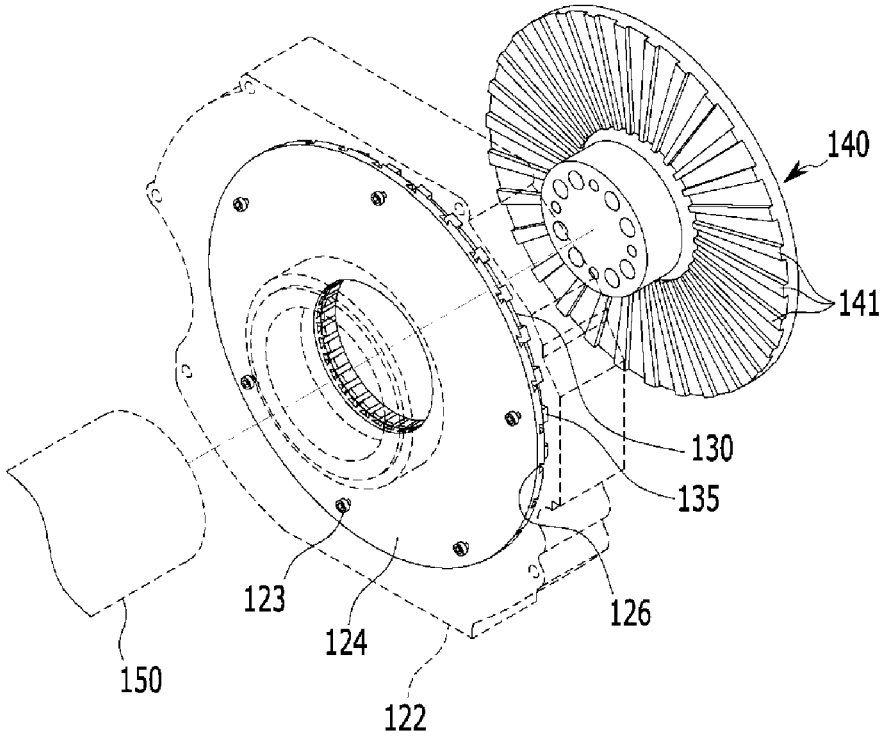
Figure 5:
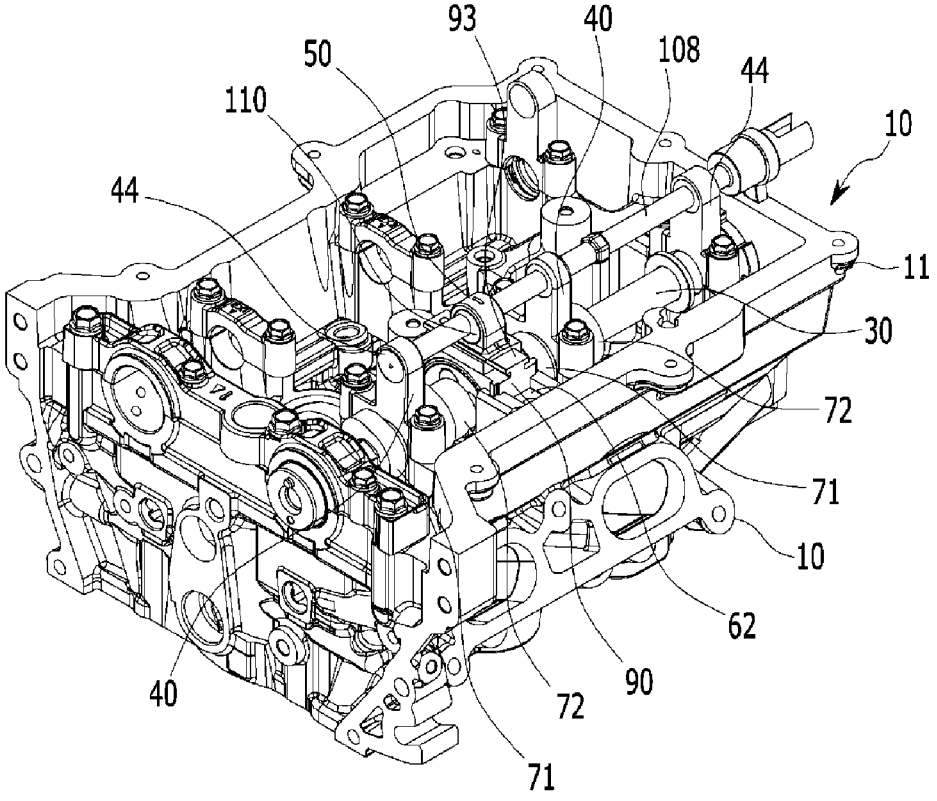
FIG. 5 is a partial perspective view of an engine applied to a powertrain of the present disclosure.

FIG. 3 and FIG. 4 are partial exploded perspective views of a motor assembly applied to a powertrain of the present disclosure, and FIG. 5 is a partial perspective view of an engine applied to a powertrain of the present disclosure.

Figure 6:
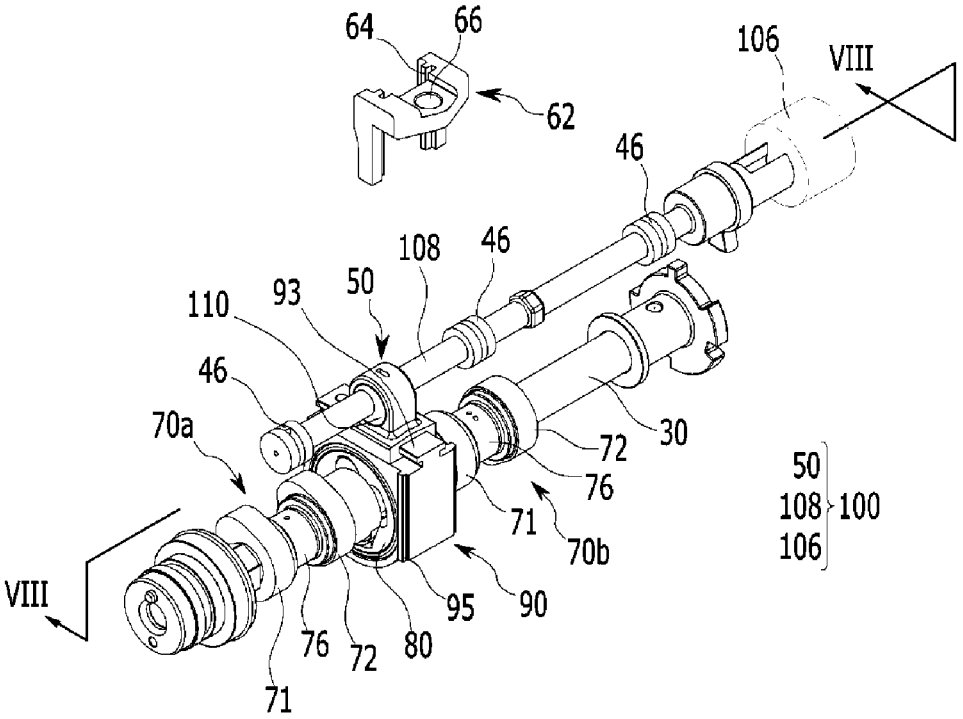
FIG. 6 and FIG. 7 are exploded perspective views of a continuous variable valve duration apparatus applied to a powertrain of the present disclosure.
Figure 7:
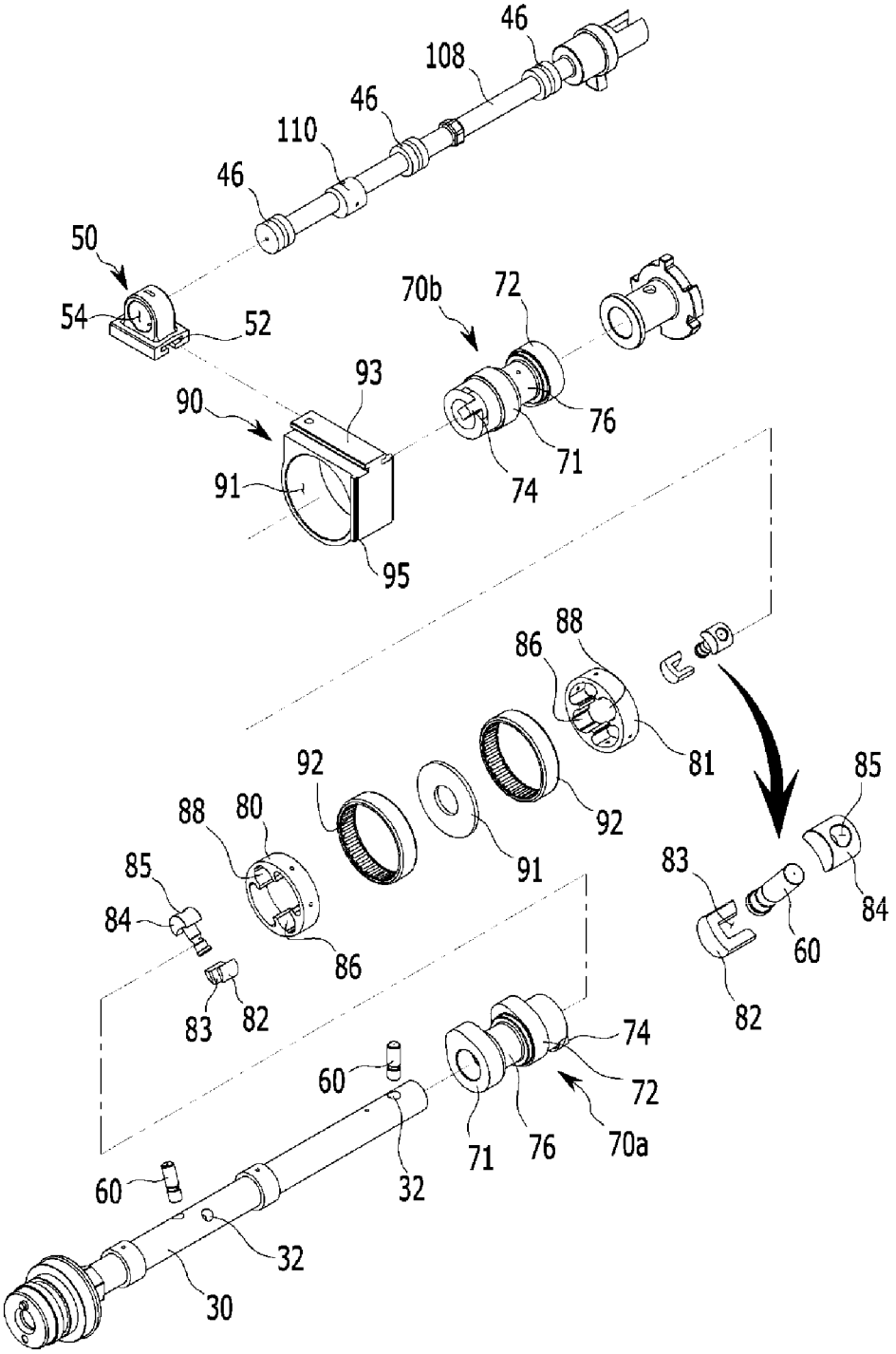
Figure 8:
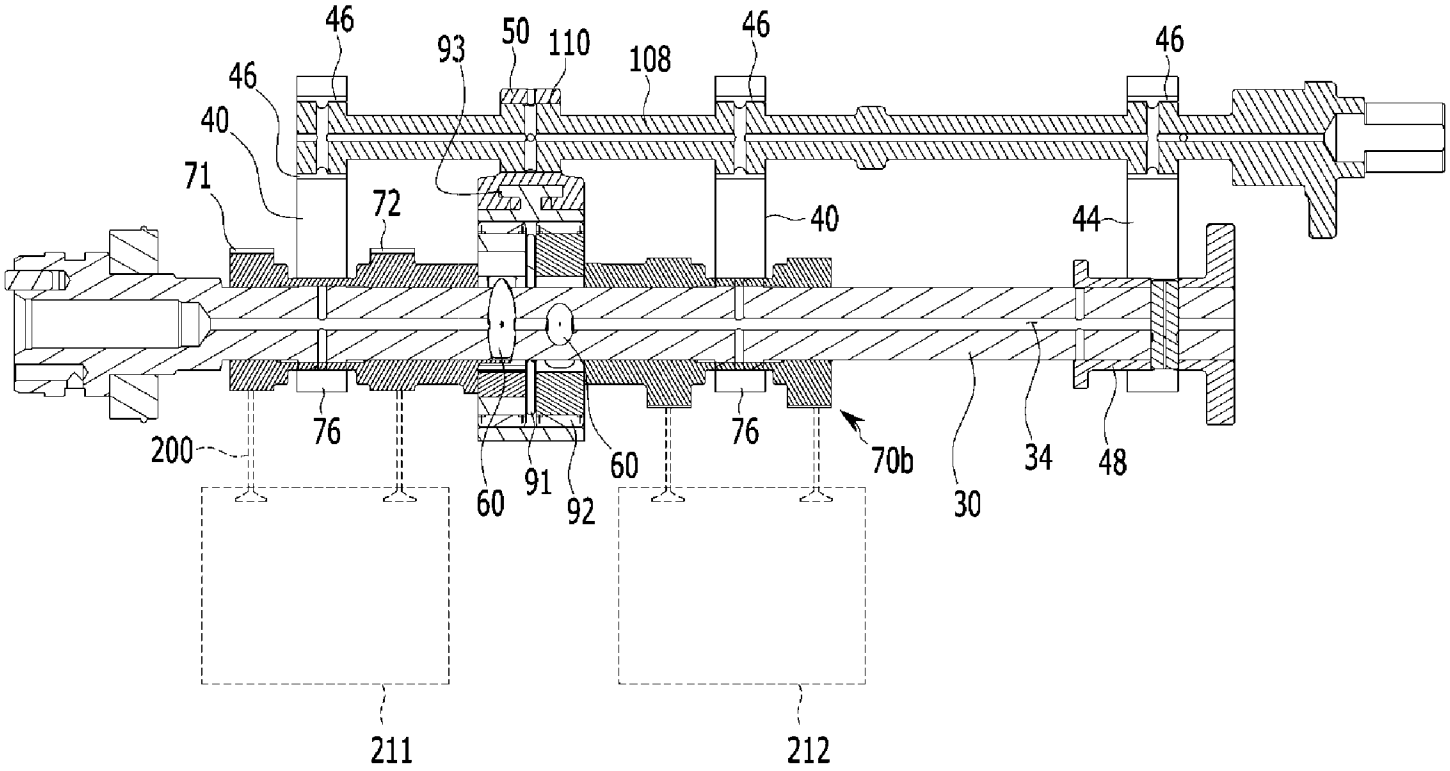
FIG. 8 is a cross-sectional view along line VIII-VIII of FIG. 6.

FIG. 6 and FIG. 7 are exploded perspective views of a continuous variable valve duration apparatus applied to a powertrain of the present disclosure, and FIG. 8 is a cross-sectional view along line VIII-VIII of FIG. 6.

Figure 9:
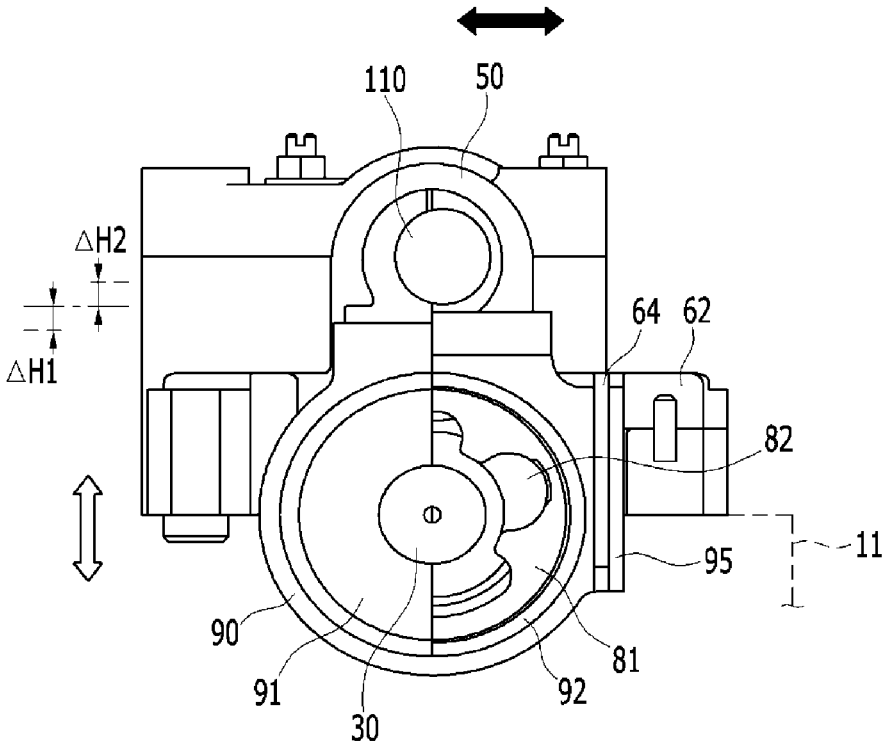
FIG. 9 is a drawing showing operations of a continuous variable valve duration apparatus applied to a powertrain of the present disclosure.

FIG. 9 is a drawing showing operations of a continuous variable valve duration apparatus applied to a powertrain of the present disclosure.

FIG. 1 to referring to FIG. 9, a powertrain according to one form of the present disclosure includes an engine 1, a transmission 155 and a motor assembly 120 disposed between and connected to the engine 1 and the transmission 155.

The engine 1 includes a cylinder head 10 to which a cam carrier 11 is mounted and an engine housing 12 connected to the cylinder head 10 and the engine 1 is a two-cylinder engine.

The powertrain according to one form of the present disclosure includes a camshaft 30 mounted to the cam carrier 11, a first cam portion 70*a* on which a cam 71 is formed, in which the camshaft 30 is inserted, of which relative phase angle with respect to the camshaft 30 is variable and disposed to correspond to a first cylinder 211; a second cam portion 70*b* on which a cam 71 is formed, in which the camshaft 30 is inserted, of which relative phase angle with respect to the camshaft 30 is variable and disposed to correspond to a second cylinder 212; a first and second inner bracket 80 and 81 transmitting rotation of the camshaft 30 to the first and second cam portions 70*a* and 70*b* respectively; a slider housing 90 in which the first and the second inner brackets 80 and 81 are rotatably inserted and of which a relative position with respect to the cam shaft 30 is variable; a lifter control portion 100 controlling the relative position of the slider housing 90; the motor assembly 120 engaged with the engine housing 12 and in which a flywheel 140 connected with a crankshaft 150 is rotatably disposed; and the transmission 155 connected with the motor assembly 120.

The lifter control portion 100 includes a control shaft 108 parallel to the camshaft 30 and on which a control rod 110 is eccentrically formed.

A first guiding portion 93 is formed to an upper portion of the slider housing 90 and a second guiding portion 95 is formed vertical or perpendicular to the first guiding portion 93 to the slider housing 90.

The lifter control portion 100 further includes a guide head 50 on which a head guiding portion 52 slidably connected with the first guiding portion 93 is formed and on which a head hole 54 where the control rod 110 is rotatably inserted into is formed.

A housing guide 62 on which a guide rail 64 engaged with the second guiding portion 95 is formed is mounted to the cam carrier 11 for guiding movement of the slider housing 90.

Since the housing guide 62 which is separately formed is engaged with the cam carrier 11, thus vibration or noise due to accumulated tolerance of elements may be alleviated or suppressed.

The first guiding portion 93 and the head guiding portion 52 are slidable to each other, the second guiding portion 95 and the guide rail 64 are slidable to each other, and eccentric rotation of the control rod 110 is transferred to a left and right direction movement of the guide head 50 and an up and down direction movement of the slider housing 90. Thus, smooth and precise control of a position of the slider housing 90 may be possible.

Two cams 71 and 72 may be formed to the first and the second cam portion 70*a* and 70*b* respectively and a cam connecting portion 76 may be formed between the two cams 71 and 72. A cam cap 40 for rotatably supporting the control shaft 108 and the cam cap connecting portion 76 is mounted to the cam carrier 11.

The cams 71 and 72 rotate to open the valve 200.

A cam key 74 is formed to the first and second cam portions 70*a* and 70*b* respectively and a first sliding hole 86 and a second sliding hole 88 are formed in the first and second inner brackets 80 and 81 respectively.

A cam key pin 82 in which a cam key slot 83 is formed and into which the cam key 74 is slidably inserted, and the cam key pin 82 is rotatably inserted into the each first sliding hole 86.

A camshaft hole 32 is formed to the camshaft 30 and a camshaft pin 60 is inserted into the camshaft hole 32 to be connected to the camshaft 30. And a slider pin 84 in which a camshaft pin slot 85 is formed and into which the camshaft pin 60 is slidably inserted, and the slider pin 84 is rotatably inserted into the each second sliding hole 88.

A slider housing bearing 92 may be disposed between the slider housing 90 and the first and the second inner brackets 80 and 81 respectively, and thus relative rotations between the slider housing 90 and the first and the second inner brackets 80 and 81 and rigidity may be obtained. The slider housing bearing 92 may be a needle bearing, a ball bearing, a roller bearing and so on.

A partition 91 is disposed in the slider housing 90 between the first and second inner brackets 80 and 81 for preventing the rotations of the first and second inner brackets 80 and 81 from being interrupted.

As shown in FIG. 6, since the slider housing 90 is disposed between the first cam portion 70*a* and the second cam portion 70*b*, the engine layout may be simplified and one slider housing 90 may control rotational speed of the first cam portion 70*a* and the second cam portion 70*b* simultaneously. Thus, the engine 1 of the powertrain may be constructed more simply and the number of elements may be reduced.

A control shaft supporting portion 44 is connected to the cam carrier 11 for supporting the control shaft 108.

A spacer 48 is disposed between the control shaft 108 and the control shaft supporting portion 44.

A support bushing 46 is connected to the control shaft 108 and is rotatably connected with the cam cap 40 and the control shaft supporting portion 44.

The powertrain according to one form of the present disclosure may share considerable elements with a four-cylinder engine so that production cost may be reduced.

The spacer 48 may be disposed between the control shaft 108 and the control shaft supporting portion 44 for applying a control shaft and so on which is applied to a general four cylinder engine and to the two cylinder engine which may be applied to the powertrain according to one form of the present disclosure. The spacer 48 may be positioned to a cam portion which is applied to the general four cylinder engine and support the camshaft 30.

The motor assembly 120 includes a motor housing 122 connected to the engine housing 12, a stator plate 124 connected to the motor housing 122, and a core plate 130 connected to the stator plate 124 and to which a coil 135 is wound, and magnets 141 corresponding to the coil 135 are connected to the flywheel 140.

Coil grooves 126 are formed to the stator plate 124 extending in a radial direction and along a circumferential direction and the coil 135 is inserted into the coil grooves 126.

The motor housing 122 and the stator plate 124 are connected by bolts 123 so that assembly and disassembly may be easily performed.

Since the stator plate 124 and the core plate 130 are disposed between the flywheel 140 and the motor housing 122, assembly may be easily performed and connection of the stator plate 124 and the core plate 130 may be stable.

Since the coil 135 is inserted into the coil groove 126, the coil 135 may be stably wound in predetermined positions without additional elements for fixing the coil 135.

Also, since the coil 135 and the magnets 141 are disposed in a radial direction, the total length of the powertrain according to one form of the present disclosure may be reduced.

In one form of the present disclosure, the two cylinder engine is applied so that enhancement of fuel efficiency is expected, but output performance may be limited and vibration may be excessive.

However, in one form of the present disclosure, the motor assembly 120 disposed between the engine 1 and the transmission 155 may function as a flywheel and a motor so that may reduce or offset vibration of the engine 1 and assist output of the engine 1.

That is, the motor assembly 120 may generate counter torque against the vibration of the engine 1 and reduce the vibration of the engine 1.

Figure 10:
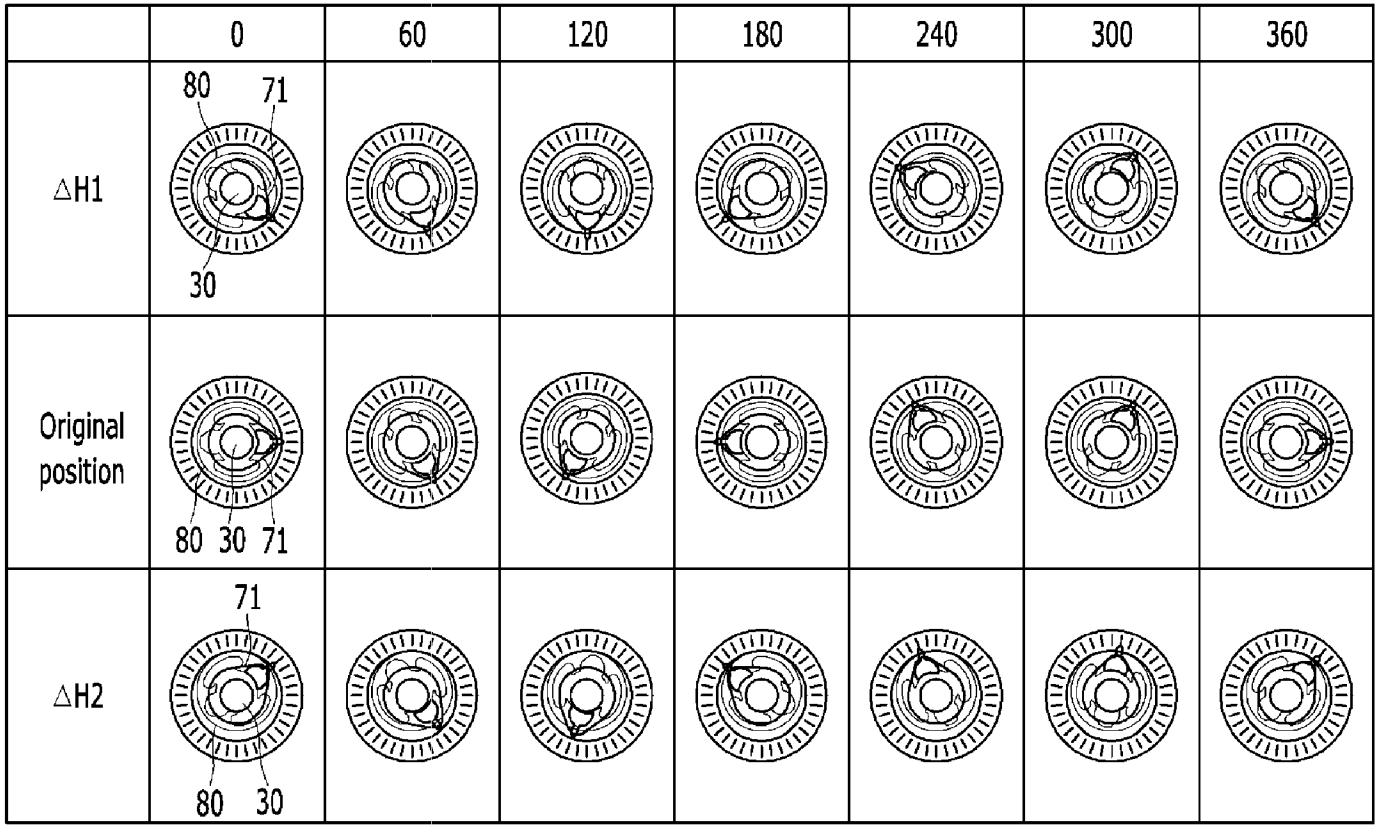
FIG. 10 is a table showing various operations of a continuous variable valve duration apparatus applied to a powertrain of the present disclosure.
Figure 11:
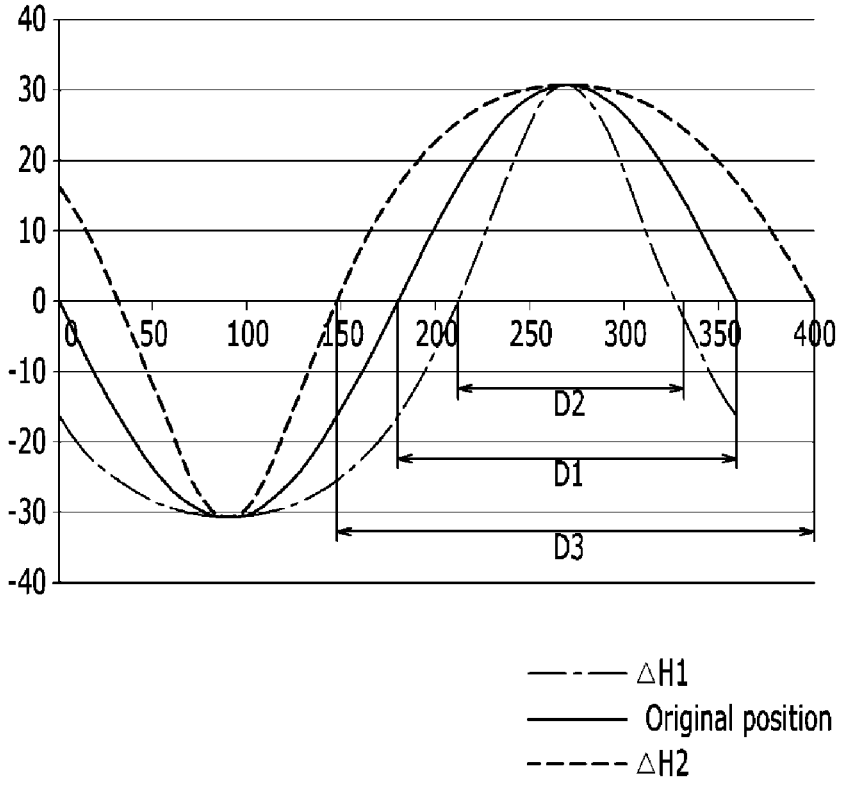
FIG. 11 is a graph showing various operations of a continuous variable valve duration apparatus applied to a powertrain of the present disclosure.

FIG. 10 is a table showing various operations of a continuous variable valve duration apparatus applied to a powertrain of the present disclosure, and FIG. 11 is a graph showing various operations of a continuous variable valve duration apparatus applied to a powertrain of the present disclosure.

Referring to FIG. 1 to FIG. 11, operations of a powertrain according to the present disclosure will be described.

When rotation centers of the camshaft 30 and the first and second inner brackets 80 and 81 are coincident, that is, the slider housing 90 is positioned at an original position as shown in FIG. 10 the cams 71 and 72 rotate with the same phase angle of the camshaft 30. That is, the cams 71 and 72 and the camshaft 30 rotate with the same speed.

According to engine operation states, an ECU (engine control unit or electric control unit) transmits control signals to the control motor 106 of the control portion 100 to rotate the control shaft 108. Then, the control rod 110 eccentrically formed to the control shaft 108 rotates and the rotation of the control rod 110 is transferred to a left and right direction movement of the guide head 50 and an up and down direction movement of the slider housing 90.

According to the rotation of the control shaft 108, positions of the slider housing 90 and the first and the second inner brackets 80 and 81 with respect to a rotation center of the camshaft 30 are changed upward or downward.

When, the position of the slider housing 90 with respect to the camshaft 30 is changed, the relative rotation speed of the cams 71 and 72 with respect to the rotation speed of the camshaft 30 is changed.

While the camshaft pin 60 is rotated together with the camshaft 30, the camshaft pin 60 is slidable within the camshaft pin slot 85, the slider pin 84 is rotatably inserted into the second sliding hole 88, the cam key pin 82 is rotatably inserted into the first sliding hole 82, and the cam key 74 is slidable within the cam key slot 83. Thus the relative rotation speed of the cams 71 and 72 with respect to the rotation speed of the camshaft 30 is changed.

As shown in FIG. 9, while the phase angle of the camshaft 30 is constantly changed when the relative position of the slider housing 90 with respect to the rotation center of the camshaft 30 is changed downward as ΔH1, as shown in FIG. 10, the rotation speed of the cams 71 and 72 is relatively slower than rotation speed of the camshaft 30 near 60 to 120 degrees, then the rotation speed of the cams 71 and 72 is relatively faster than the rotation speed of the camshaft 30 near 240 to 300 degrees.

As shown in FIG. 9, while the phase angle of the camshaft 30 is constantly changed when the relative position of the slider housing 90 with respect to the rotation center of the camshaft 30 is changed upward as ΔH2, as shown in FIG. 10, the rotation speed of the cams 71 and 72 is relatively faster than rotation speed of the camshaft 30 near 60 to 120 degrees, then the rotation speed of the cams 71 and 72 is relatively slower than rotation speed of the camshaft 30 near 240 to 300 degrees.

That is, as shown in FIG. 11 valve duration D2 in the case that the relative position of the slider housing 90 is changed to ΔH1 is shorter than valve duration D1 in the case that the position of the slider housing 90 is at the original position.

Also, valve duration D3 in the case that the relative position of the slider housing 90 is changed to ΔH2 is longer than valve duration D1 in the case that the position of the slider housing 90 is at the original position.

In FIG. 11, for better comprehension and ease of description, peak points in FIG. 10 are constant, but it is not limited thereto.

According to adjusting contacting positions of the valve 200 and the cam 71 and 72, contacting angles of the valve 200 and the cam 71 and 72, a position of the cam key 74 and so on, valve duration may be enlarged by advancing opening timing and retarding closing timing of the valve 200. Or, valve duration may be shortened by retarding opening timing and advancing closing timing of the valve 200.

Also, opening timing of the valve 200 may be constant and closing timing of the valve 200 may be retarded or advanced as requested.

Also, closing timing of the valve 200 may be constant and opening timing of the valve 200 may be retarded or advanced as requested.

FIG. 12 is a drawing showing a slider pin applied to a powertrain of the present disclosure.

In one form, the camshaft pin and the slider pin are disconnected, however a slider pin 160 as shown in FIG. 12 includes a pin body 162 slidably inserted into the camshaft hole 32 of camshaft 30 and a pin head 164 integrally formed with the pin body 162 and rotatably inserted into the second sliding hole 88.

A camshaft oil hole 34 (referring to FIG. 8) is formed in the camshaft 30 along a length direction thereof and a body oil hole 166 in fluid communication with the camshaft oil hole 34 is formed in the pin body 162.

And an oil groove 168 in fluid communication with the body oil hole 166 is formed in the pin head 164 through a communicating hole 169.

Lubricant may be supplied from the camshaft oil hole 34 to the oil groove 168 through the body oil hole 166 and the communicating hole 169, thus friction between the pin head 164 and the second sliding hole 88 may be reduced.

Except the slider pin, operations and structures of the powertrain according to a modified form of the present disclosure are the same as forms described above, repeated description will be omitted.

As described above, a powertrain of the present disclosure may perform various valve durations according to operation conditions of an engine so that enhance fuel efficiency and increase output.

Also, the powertrain according to forms of the present disclosure may suppress vibration and reduce engine size by applying the motor assembly.

Also, radial disposition of the rotor and the stator may decrease the length of the powertrain.

While this disclosure has been described in connection with what is presently considered to be practical forms, it is to be understood that the disclosure is not limited to the disclosed forms. On the contrary, it is intended to cover various modifications and equivalent arrangements included within the spirit and scope of the present disclosure.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A powertrain comprising:

an engine housing connected to a cylinder head, and a cam carrier mounted to the cylinder head;

a camshaft mounted to the cam carrier;

a first cam portion on which a first cam is formed, in which the camshaft is inserted, of which a first relative phase angle with respect to the camshaft is variable and disposed to correspond to a first cylinder;

a second cam portion on which a second cam is formed, in which the camshaft is inserted, of which a second relative phase angle with respect to the camshaft is variable and disposed to correspond to a second cylinder;

first and second inner brackets transmitting rotation of the camshaft to the first and second cam portions, respectively;

a slider housing in which the first and the second inner brackets are rotatably inserted and of which a relative position with respect to the cam shaft is variable;

a lifter control portion controlling the relative position of the slider housing;

a motor assembly engaged with the engine housing and in which a flywheel connected with a crankshaft is rotatably disposed; and a transmission connected with the motor assembly.

2. The powertrain of claim 1, further comprising:

a first guiding portion formed to an upper portion of the slider housing; and a second guiding portion formed vertical to the first guiding portion, wherein the lifter control portion comprises a control shaft parallel to the camshaft and on which a control rod is eccentrically formed, and wherein the powertrain further comprises a guide head on which a head guiding portion slidably connected with the first guiding portion is formed and on which a head hole where the control rod is rotatably inserted into is formed.

3. The powertrain of claim 2, further comprising a housing guide on which a guide rail engaged with the second guiding portion is formed and mounted to the cam carrier for guiding movement of the slider housing.

4. The powertrain of claim 2, further comprising:

a cam key formed in the first and second cam portions respectively;

a first sliding hole formed in the first and second inner brackets respectively; and a cam key pin on which a cam key slot is formed and in which the cam key is slidably inserted, the cam key pin rotatably inserted into the first sliding hole in the first and second inner brackets.

5. The powertrain of claim 2, further comprising:

a second sliding hole formed in the first and second inner brackets respectively;

a camshaft pin connected to the camshaft; and a slider pin on which a camshaft pin slot is formed and in which the camshaft pin is slidably inserted, the slider pin rotatably inserted into the second sliding hole in the first and second inner brackets.

6. The powertrain of claim 2, further comprising a slider housing bearing disposed between the first and the second inner brackets and the slider housing respectively.

7. The powertrain of claim 2, further comprising a partition disposed between the first and the second inner brackets.

8. The powertrain of claim 2, further comprising:

a cam cap connecting portion is formed between each of a pair of first cams and a pair of second cams of each cam portion; and a cam cap configured to rotatably support the control shaft and the cam cap connecting portion and mounted to the cam carrier, wherein the first cam formed to the first cam portion is the pair of first cams and the second cam formed to the second cam portion is the pair of second cams.

9. The powertrain of claim 2, further comprising a control shaft supporting portion supporting the control shaft.

10. The powertrain of claim 9, further comprising a spacer disposed between the control shaft and the control shaft supporting portion.

11. The powertrain of claim 2, further comprising:

a cam key is formed on the first and second cam portions respectively;

a first and a second sliding hole are formed in the first and the second inner brackets respectively;

a cam key pin on which a cam key slot is formed and in which the cam key is slidably inserted, is rotatably inserted into the first sliding hole of the first and second inner brackets; and a slider pin including a pin body and a pin head integrally formed with the pin body, and wherein the pin body is slidably inserted into the camshaft and the pin head is rotatably inserted into the second sliding hole of the first and the second inner brackets.

12. The powertrain of claim 11, further comprising:

a camshaft oil hole is formed in the camshaft along a length direction thereof;

a body oil hole in fluid communication with the camshaft oil hole is formed in the pin body; and an oil groove in fluid communication with the body oil hole is formed in the pin head.

13. The powertrain of claim 1, wherein the motor assembly comprises:

a motor housing connected to the engine housing;

a stator plate connected to the motor housing;

a core plate connected to the stator plate and on which a coil is wound, and magnets corresponding to the coil and connected to the flywheel.

* * * * *